US010636559B2

(12) United States Patent
Yoshida et al.

(10) Patent No.: US 10,636,559 B2
(45) Date of Patent: Apr. 28, 2020

(54) REACTOR HAVING TERMINAL AND BASE

(71) Applicant: FANUC CORPORATION, Yamanashi (JP)

(72) Inventors: Tomokazu Yoshida, Yamanashi (JP); Masatomo Shirouzu, Yamanashi (JP); Kenichi Tsukada, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 78 days.

(21) Appl. No.: 16/000,484

(22) Filed: Jun. 5, 2018

(65) Prior Publication Data

US 2018/0358165 A1 Dec. 13, 2018

(30) Foreign Application Priority Data

Jun. 12, 2017 (JP) ..... 2017-115026

(51) Int. Cl.

| | |
|---|---|
| ***H01F 30/12*** | (2006.01) |
| ***H01F 27/26*** | (2006.01) |
| ***H01F 3/14*** | (2006.01) |
| ***H01F 37/00*** | (2006.01) |
| ***H01F 27/06*** | (2006.01) |
| ***H01F 27/28*** | (2006.01) |

(52) U.S. Cl.

CPC ..... *H01F 27/26* (2013.01); *H01F 3/14* (2013.01); *H01F 27/06* (2013.01); *H01F 27/263* (2013.01); *H01F 27/266* (2013.01); *H01F 27/28* (2013.01); *H01F 37/00* (2013.01)

(58) Field of Classification Search

CPC ..... H01F 30/12; H01F 3/12

USPC ..... 336/5

See application file for complete search history.

(56) References Cited

U.S. PATENT DOCUMENTS

| | | | | |
|---|---|---|---|---|
| 8,502,631 | B2 * | 8/2013 | Cavender | H01F 3/14 336/170 |
| 9,613,745 | B2 * | 4/2017 | Shudarek | H01F 37/00 |
| 10,008,322 | B2 * | 6/2018 | Bhide | H01F 37/00 |
| 2009/0261939 | A1 * | 10/2009 | Shudarek | H01F 3/10 336/212 |
| 2013/0187741 | A1 * | 7/2013 | Goodrich | H01F 3/10 336/170 |
| 2015/0235752 | A1 * | 8/2015 | Stryken | H01F 27/24 336/5 |

(Continued)

FOREIGN PATENT DOCUMENTS

| | | | |
|---|---|---|---|
| CN | 106816279 | A | 6/2017 |
| DE | 1513862 | A1 | 4/1969 |

(Continued)

*Primary Examiner* — Ronald Hinson

(74) *Attorney, Agent, or Firm* — RatnerPrestia

(57) ABSTRACT

A core body of a reactor includes an outer peripheral iron core composed of a plurality of outer peripheral iron core portions, at least three iron cores coupled to the plurality of outer peripheral iron core portions, and coils wound onto the at least three iron cores. The reactor includes a terminal and base which are fastened to the core body so as to interpose the core body therebetween, a first abutment member attached to the base and is configured to abut one end of the at least three iron cores between the base and the core body, and a second abutment member attached to the terminal and is configured to abut the other end of the at least three iron cores between the core body and the terminal.

7 Claims, 8 Drawing Sheets

(56) References Cited

U.S. PATENT DOCUMENTS

| | | | | |
|---|---|---|---|---|
| 2016/0343503 | A1* | 11/2016 | Ueno | H01F 30/08 |
| 2017/0040099 | A1* | 2/2017 | Bhide | H01F 27/245 |
| 2018/0268991 | A1 | 9/2018 | Tsukada et al. | |

FOREIGN PATENT DOCUMENTS

| | | | |
|---|---|---|---|
| JP | 2000-077242 | A | 3/2000 |
| JP | 2008-210998 | A | 9/2008 |
| JP | 2017059805 | A | 3/2017 |
| JP | 6378385 | B1 | 8/2018 |
| WO | 9959236 | A1 | 11/1999 |
| WO | 2010119324 | A2 | 10/2010 |

* cited by examiner

REACTOR HAVING TERMINAL AND BASE

BACKGROUND OF THE INVENTION

1. Field of the Invention

The present invention relates to a reactor having a terminal and a base.

2. Description of the Related Art

Reactors include a plurality of iron core coils, and each iron core coil includes an iron core and a coil wound onto the iron core. Predetermined gaps are formed between the plurality of iron cores. Refer to, for example, Japanese Unexamined Patent Publication (Kokai) No. 2000-77242 and Japanese Unexamined Patent Publication (Kokai) No. 2008-210998.

SUMMARY OF THE INVENTION

There are reactors in which a plurality of iron core coils are arranged inside an outer peripheral iron core composed of a plurality of outer peripheral iron core portions. In such reactors, the iron cores are integrally formed with the respective peripheral iron core portions. Predetermined gaps are formed between adjacent iron cores in the center of the reactor. In such a case, in order to tightly fasten the outer peripheral iron core, a through-hole is formed in the center of the reactor, a rod extends through the through-hole, and both ends of the rod are fastened to the end faces of the reactor by means of flexible metal plates or the like.

However, since the gaps are located at the center of the reactor, forming a through-hole shortens the gap length accordingly. Since there is a portion where the magnetic flux does not pass through the through-hole, if the gap length becomes short, an expected inductance cannot be guaranteed. Thus, in order to guarantee the necessary gap length, it is necessary to increase the width of the iron core and extend the gaps radially outward, resulting in a problem that the iron cores and the outer peripheral iron core become large.

Thus, a reactor which is capable of tightly fastening a plurality of iron cores without an increase in the sizes of the iron cores and the outer peripheral iron core is desired.

According to the first aspect of the present disclosure, there is provided a reactor comprising a core body, the core body comprising an outer peripheral iron core composed of a plurality of outer peripheral iron core portions, at least three iron cores coupled to the plurality of outer peripheral iron core portions, and coils wound onto the at least three iron cores, wherein gaps, which can be magnetically coupled, are formed between one of the at least three iron cores and another iron core adjacent thereto, the reactor further comprising a terminal and a base which are fastened to the core body so as to interpose the core body therebetween, a first abutment member attached to the base and is configured to abut one end of the at least three iron cores between the base and the core body, and a second abutment member attached to the terminal and is configured to abut the other end of the at least three iron cores between the core body and the terminal.

In the first aspect, since the abutment members abut the centers of the opposite end surfaces of the core body, the plurality of iron coils can be tightly fastened. Further, since it is not necessary to form a through-hole in the center of the core body to fasten the plurality of iron cores, it is not necessary to increase the widths of the iron cores to ensure the gap length. Thus, it is possible to tightly fasten the plurality of iron cores without an increase in the sizes of the iron cores and the outer peripheral iron core.

The object, features, and advantages of the present disclosure, as well as other objects, features and advantages, will be further clarified by the detailed description of the representative embodiments of the present disclosure shown in the accompanying drawings.

DETAILED DESCRIPTION

Figure 1A:
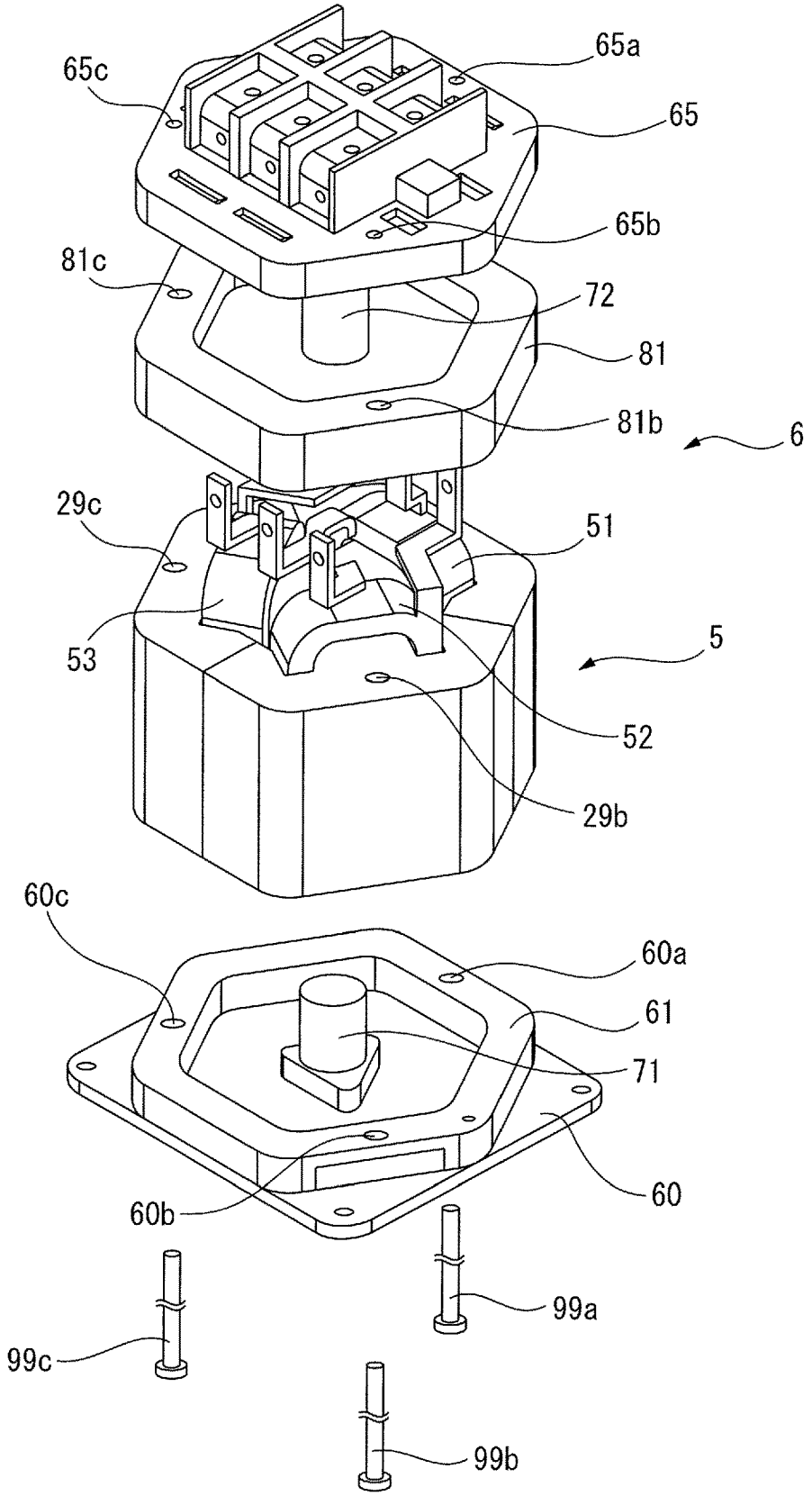
FIG. 1A is an exploded perspective view of a reactor according to a first embodiment.

The embodiments of the present invention will be described below with reference to the accompanying drawings. In the following drawings, the same components are given the same reference numerals. For ease of understanding, the scales of the drawings have been appropriately modified.

In the following description, a three-phase reactor will be described as an example. However, the present disclosure is not limited in application to a three-phase reactor, but can be broadly applied to any multiphase reactor requiring constant inductance in each phase. Further, the reactor according to the present disclosure is not limited to those provided on the primary side or secondary side of the inverters of industrial robots or machine tools, but can be applied to various machines.

Figure 1B:
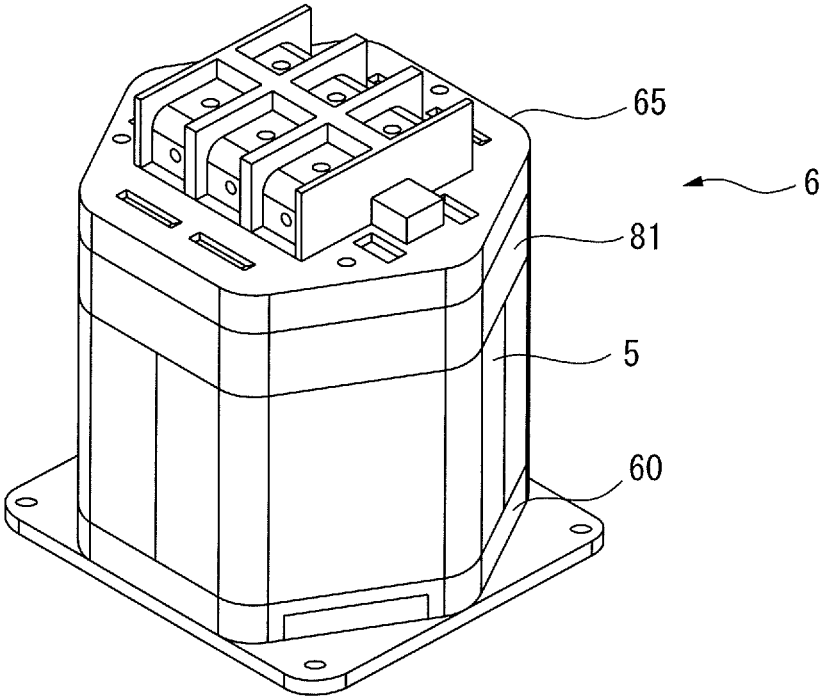
FIG. 1B is a perspective view of the reactor shown in FIG. 1A.

FIG. 1A is an exploded perspective view of a reactor according to a first embodiment. FIG. 1B is a perspective view of the reactor shown in FIG. 1A. As shown in FIG. 1A and FIG. 1B, a reactor 6 mainly includes a core body 5, a base 60 fastened to one end of the core body 5, an annular end plate 81 fastened to the other end of the core body 5, and a terminal block 65 fastened to the end plate 81. In other words, the opposite ends of the core body 5 are interposed in the axial direction between the base 60 and the end plate 81 having the terminal block 65 attached thereto. Note that the terminal block 65 may include, on the lower surface thereof, a protrusion (not shown) having a shape similar to that of the end plate 81. In such a case, the end plate 81 may be omitted.

An annular projection 61 having an outer shape corresponding to the end surface of the core body 5 is provided on the base 60. Through-holes 60*a* to 60*c* which penetrate the base 60 are formed in the projection 61 at equal intervals in the circumferential direction. The end plate 81 has a similar outer shape, and through-holes 81*a* to 81*c* are also formed in the end plate 81 at equal intervals in the circumferential direction. The height of the projection 61 of the base 60 and the height of the end plate 81 are slightly greater than the projecting height of the coils 51 to 53 protruding from the end of the core body 5.

The terminal block 65 includes multiple, for example, six, terminals. The plurality of terminals are connected to the corresponding leads extending from the coils 51 to 53. Furthermore, through-holes 65*a* to 65*c* are formed in the terminal block 65 at equal intervals in the circumferential direction.

Figure 2:
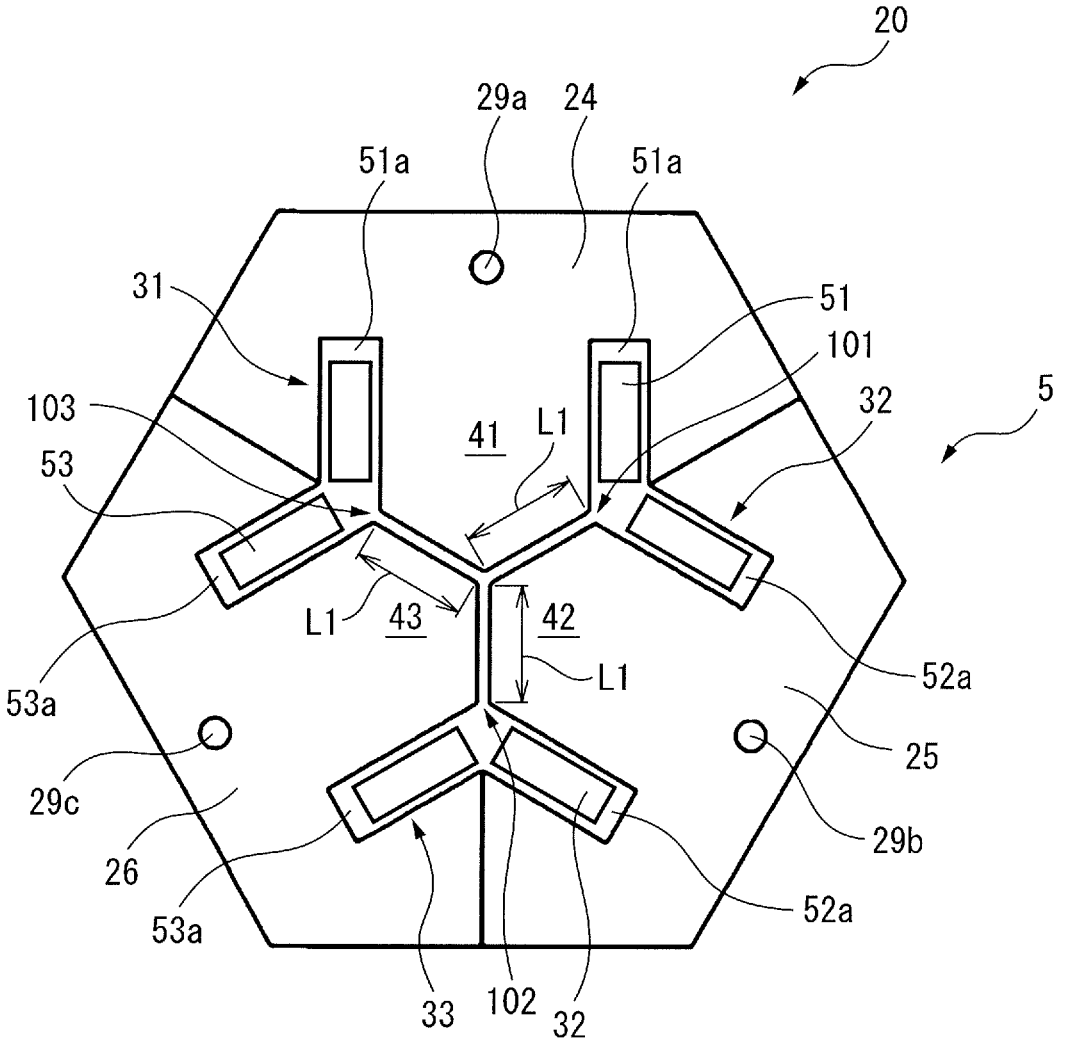
FIG. 2 is a cross-sectional view of the core body of the reactor according to the first embodiment.

FIG. 2 is a cross-sectional view of the core body of the reactor according to the first embodiment. As shown in FIG. 2, the core body 5 of the reactor 6 includes an annular outer peripheral iron core 20 and three iron core coils 31 to 33 arranged inside the outer peripheral iron core 20. In FIG. 1, the iron core coils 31 to 33 are disposed inside the substantially hexagonal outer peripheral iron core 20. These iron core coils 31 to 33 are arranged at equal intervals in the circumferential direction of the core body 5.

Note that the outer peripheral iron core 20 may have another rotationally symmetrical shape, such as a circular shape. In such a case, the outer peripheral iron core 20 has a shape corresponding to the terminal block 65, the base 60, and the end plate 81. Furthermore, the number of iron core coils may be a multiple of three, whereby the reactor 6 can be used as a three-phase reactor.

As can be understood from the drawings, the iron core coils 31 to 33 include iron cores 41 to 43, which extend in the radial directions of the outer peripheral iron core 20, and coils 51 to 53 wound onto the iron cores, respectively.

The outer peripheral iron core 20 is composed of a plurality of, for example, three, outer peripheral iron core portions 24 to 26 divided in the circumferential direction. The outer peripheral iron core portions 24 to 26 are formed integrally with the iron cores 41 to 43, respectively. The outer peripheral iron core portions 24 to 26 and the iron cores 41 to 43 are formed by stacking a plurality of iron plates, carbon steel plates, or electromagnetic steel sheets, or are formed from a dust core. When the outer peripheral iron core 20 is formed from a plurality of outer peripheral iron core portions 24 to 26, even if the outer peripheral iron core 20 is large, such a large outer peripheral iron core 20 can be easily manufactured. Note that the number of iron cores 41 to 43 and the number of iron core portions 24 to 26 need not necessarily be the same. Furthermore, through-holes 29*a* to 29*c* are formed in the outer peripheral iron core portions 24 to 26.

The coils 51 to 53 are arranged in coil spaces 51*a* to 53*a* formed between the outer peripheral iron core portions 24 to 26 and the iron cores 41 to 43, respectively. In the coil spaces 51*a* to 53*a*, the inner peripheral surfaces and the outer peripheral surfaces of the coils 51 to 53 are adjacent to the inner walls of the coil spaces 51*a* to 53*a*.

Further, the radially inner ends of the iron cores 41 to 43 are each located near the center of the outer peripheral iron core 20. In the drawings, the radially inner ends of the iron cores 41 to 43 converge toward the center of the outer peripheral iron core 20, and the tip angles thereof are approximately 120 degrees. The radially inner ends of the iron cores 41 to 43 are separated from each other via gaps 101 to 103, which can be magnetically coupled.

In other words, the radially inner end of the iron core 41 is separated from the radially inner ends of the two adjacent iron cores 42 and 43 via gaps 101 and 103. The same is true for the other iron cores 42 and 43. Note that, the sizes of the gaps 101 to 103 are equal to each other.

In the configuration shown in FIG. 1, since a central iron core disposed at the center of the core body 5 is not needed, the core body 5 can be constructed lightly and simply. Further, since the three iron core coils 31 to 33 are surrounded by the outer peripheral iron core 20, the magnetic fields generated by the coils 51 to 53 do not leak to the outside of the outer peripheral core 20. Furthermore, since the gaps 101 to 103 can be provided at any thickness at a low cost, the configuration shown in FIG. 1 is advantageous in terms of design, as compared to conventionally configured reactors.

Further, in the core body 5 of the present disclosure, the difference in the magnetic path lengths is reduced between the phases, as compared to conventionally configured reactors. Thus, in the present disclosure, the imbalance in inductance due to a difference in magnetic path length can be reduced.

Referring again to FIG. 1A, a first abutment member 71 extending toward the core body 5 is provided in the center of the upper surface of the base 60. The first abutment member 71 has a columnar, for example, a cylindrical, shape, and one surface thereof is provided in the center of the base 60. Likewise, a second abutment member 72 extending toward the core body 5 is provided in the center of the bottom surface of the terminal block 65.

The first abutment member 71 and the second abutment member 72 are preferably formed from a non-magnetic material, such as aluminum, SUS, or a resin, and as a result, it is possible to prevent the magnetic field from passing through the abutment members 71, 72.

Figure 3:
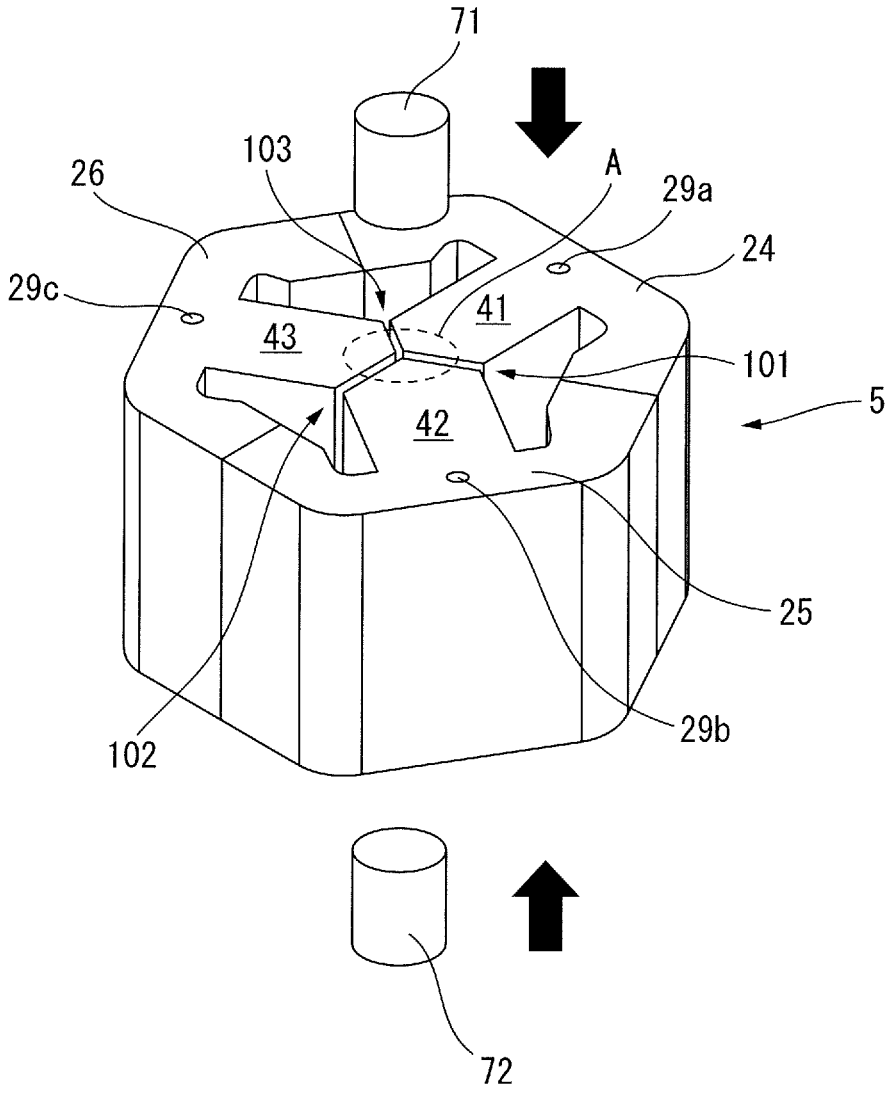
FIG. 3 is a partial perspective view of the reactor according to the first embodiment.

FIG. 3 is a partial perspective view of the reactor according to the first embodiment. For the ease of understanding, illustration of members other than the core body 5 and the abutment members 71, 72 is omitted in FIG. 3. The typical end surfaces of the abutment members 71, 72 have shapes and areas large enough to at least partially include the gaps 101 to 103. It is preferable that the circle including the radially outer ends of the gaps 101 to 103 on the circumference be the maximum area of the end surfaces of the abutment members 71, 72, whereby it is possible to make the abutment members 71, 72 lighter, while preventing the abutment members 71, 72 from interfering with the coils 51 to 53.

First, the abutment members 71, 72 are attached to the base 60 and the terminal block 65 as mentioned above. The base 60 and the terminal block 65 are then moved toward the core body 5 in the directions of the respective arrows. When the end surfaces of the abutment members 71, 72 reach the centers of the end surfaces of the core body 5, as indicated by dashed line A in FIG. 3, the iron cores 41 to 43 are positioned between the abutment members 71 and 72. Then, screws 99*a* to 99*c* (refer to FIG. 1A) are screwed through the through-holes 60*a* to 60*b* of the base 60, the through-holes 29*a* to 29*c* of the core body 5, the through-holes 81*a* to 81*c* of the end plate 81, and the through-holes 65*a* to 65*c* of the terminal block 65. As a result, while the iron cores 41 to 43 are interposed in the axial direction between the abutment members 71, 72, both ends of the iron cores 41 to 43 are tightly fastened to each other.

Figure 4:
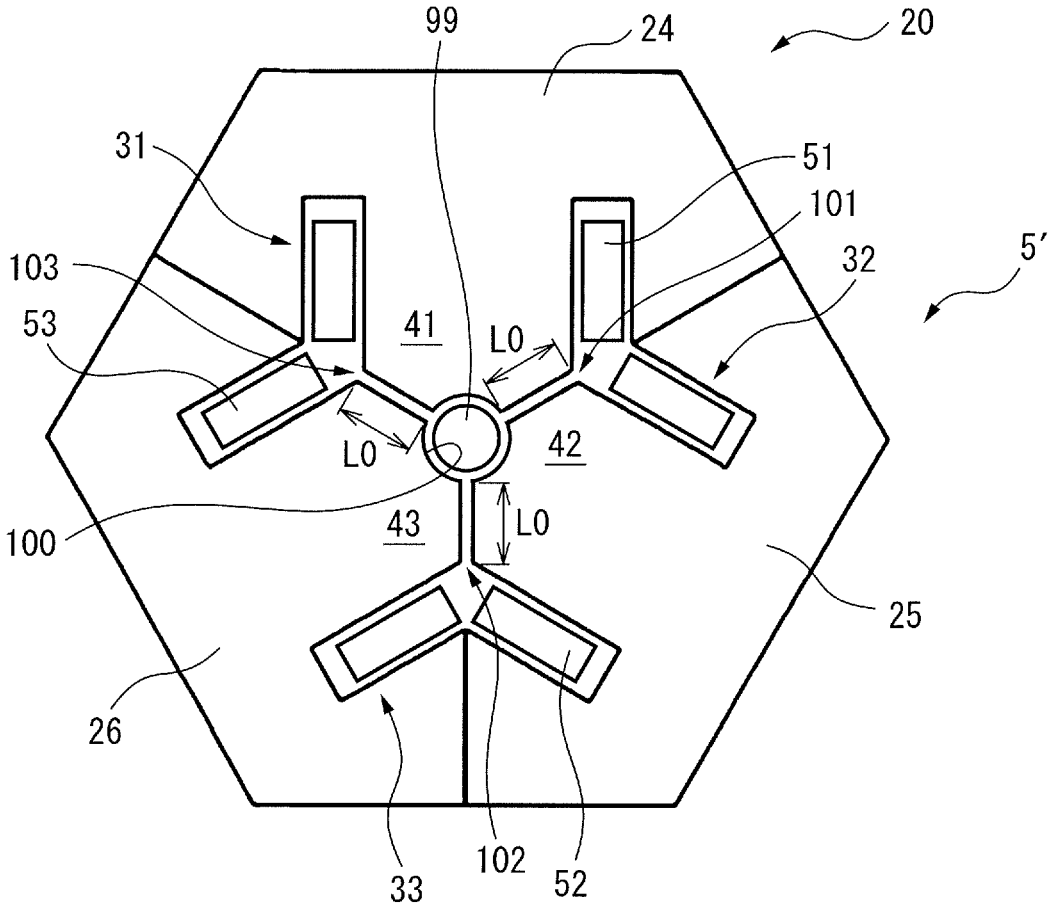
FIG. 4 is a cross-sectional view of the core body of a different reactor.

FIG. 4 is a cross-sectional view of the core body of a different reactor. The core body 5' of the different reactor shown in FIG. 4 has a configuration substantially the same as the core body 5 detailed with reference to FIG. 2. A through-hole 100 extending in the axial direction is formed at the center of the core body 5'. A rod member 99 is inserted into the through-hole. The opposite ends of the rod member 99 are fastened to both ends of the core body 5 by a fastening metal leaf, and as a result, the opposite ends of the iron cores 41 to 43 are fastened to each other.

In FIG. 4, since the opposite ends of the iron cores 41 to 43 are fastened by a single rod member 99, it is necessary to make the size of the through-hole 100 relatively large. As a result, the lengths L0 of the gaps 101 to 103 shown in FIG. 4 become shorter than the lengths L1 of the gaps 101 to 103 shown in FIG. 2. Thus, in order to secure the expected inductance, it was necessary to increase the widths of the iron cores 41 to 43 to increase the length of the gaps 101 to 103 shown in FIG. 4 to length L1.

In regards thereto, in the present disclosure, since the abutment members 71, 72 provided on the base 60 and the terminal block 65 contact the centers of the opposite surfaces of the core body 5, the plurality of iron cores 41 to 43 can be tightly fastened. Further, since it is not necessary to form a through-hole in the center of the core body 5 in order to hold the plurality of iron cores 41 to 43, it is not necessary to increase the widths of the iron cores 41 to 43 to ensure the gap length. Thus, it is possible to tightly fasten the plurality of iron cores 41 to 43 without an increase in size in the iron cores 41 to 43 and the outer peripheral iron core 20. In other words, the abutment members 71, 72 are sized so that the iron cores 41 to 43 can be tightly fastened when the reactor 6 is assembled.

Furthermore, the abutment members 71, 72 may be integrally formed with the upper surface of the base 60 and the lower surface of the terminal block 65, respectively. Alternatively, the abutment members 71, 72 may be formed to be detachable from the upper surface of the base 60 and the lower surface of the terminal block 65, respectively. In this case, the abutment members 71, 72 can be attached between the base 60 and the core body 5 of an existing reactor 6 and between the terminal block 65 and the core body 5 of the existing reactor, respectively.

Figure 5:
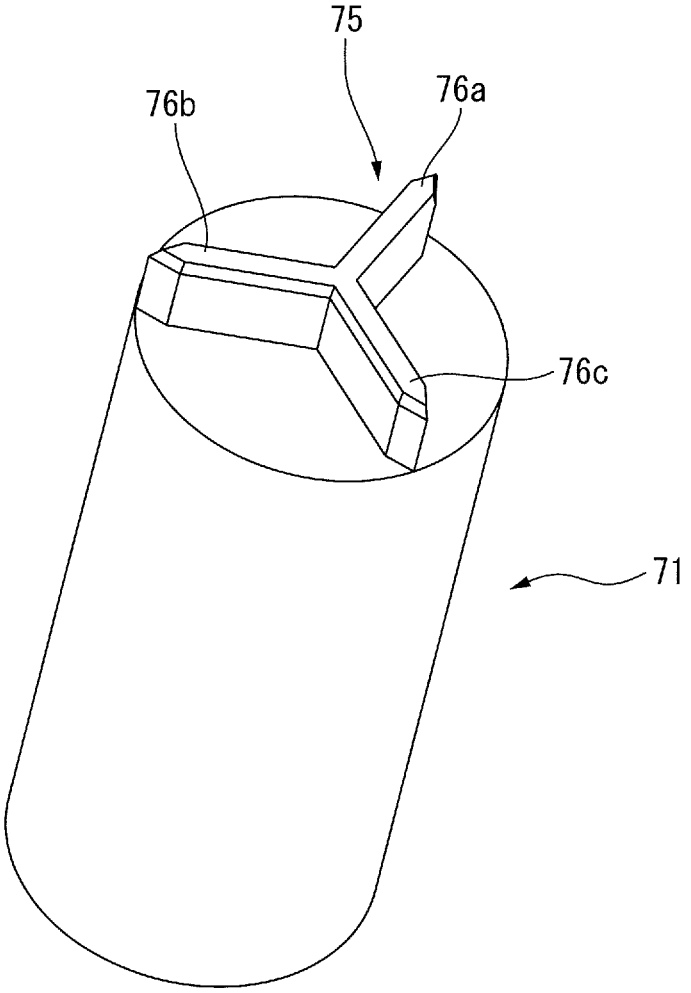
FIG. 5 is a perspective view of an abutment member used in a reactor according to another embodiment.

Further, FIG. 5 is a perspective view of an abutment member used in the reactor of another embodiment. A substantially Y-shaped projection 75 is provided on one surface of the abutment member 71. The projection 75 shown in FIG. 5 is composed of a number of raised portions 76*a* to 76*c*, the number of which is the same as the number of gaps 101 to 103. These raised portions 76*a* to 76*c* are arranged at equal intervals in the circumferential direction so as to correspond to the gaps 101 to 103. The projection 75 including the raised portions 76*a* to 76*c* is configured to be at least partially engageable with the gaps 101 to 103. A similar projection 75 may be provided on the end surface of the abutment member 72. However, providing a projection 75 on only the abutment member 71 is sufficient.

When the abutment members 71, 72 including the projections 75 are used to fasten the opposite ends of the iron cores 41 to 43, since the projections 75 engage with the gaps 101 to 103, the iron cores 41 to 43 can be more tightly fastened. Furthermore, the iron cores 41 to 43 do not vibrate when the reactor 5 is driven, and as a result, the generation of noise can be prevented. Thus, it is sufficient for the projection 75 to be formed to at least partially engage the gaps 101 to 103. For example, the projection 75 may include only two raised portions 76*a* and 76*b*.

Further, when the projection 75 shown in FIG. 5 is provided, since the projection 75 functions as a lid, foreign matter can be prevented from entering the gaps 101 to 103. Furthermore, the projection 75 may function to maintain the dimension of the gaps 101 to 103.

Figure 6:
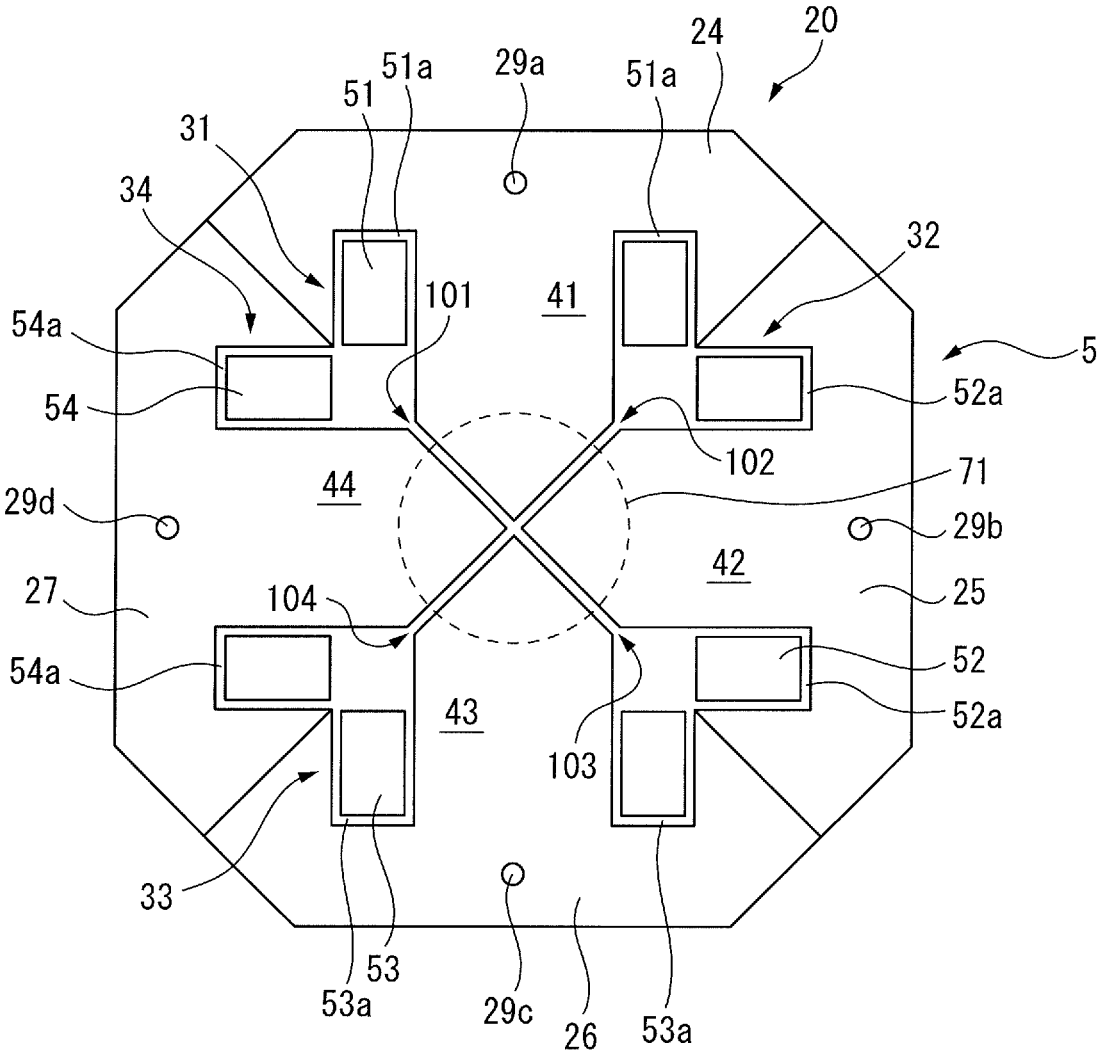
FIG. 6 is a cross-sectional view of the core body of a reactor according to a second embodiment.

The aforementioned abutment members 71, 72 may be attached to a core body other than the core body 5 shown in FIG. 2. For example, FIG. 6 is a cross-sectional view of the core body of a reactor according to a second embodiment. The core body 5 shown in FIG. 6 includes a substantially octagonal outer peripheral iron core 20 and four iron core coils 31 to 34, which are the same as the aforementioned iron core coils, arranged inside the outer peripheral iron core 20. These iron core coils 31 to 34 are arranged at equal intervals in the circumferential direction of the core body 5. Furthermore, the number of the iron cores is preferably an even number of 4 or more, so that the reactor having the core body 5 can be used as a single-phase reactor.

As can be understood from the drawing, the outer peripheral iron core 20 is composed of four outer peripheral iron core portions 24 to 27 which are divided in the circumferential direction. The iron core coils 31 to 34 include iron cores 41 to 44 extending in the radial direction and coils 51 to 54 wound onto the respective iron cores, respectively. The radially outer end portions of the iron cores 41 to 44 are integrally formed with the adjacent peripheral iron core portions 24 to 27, respectively. The number of the iron cores 41 to 44 and the number of the peripheral iron core portions 24 to 27 need not necessarily be the same. The same is true for core body 5 shown in FIG. 2.

Further, each of the radially inner ends of the iron cores 41 to 44 is located near the center of the outer peripheral iron core 20. In FIG. 6, the radially inner ends of the iron cores 41 to 44 converge toward the center of the outer peripheral iron core 20, and the tip angles thereof are about 90 degrees. The radially inner ends of the iron cores 41 to 44 are separated from each other via the gaps 101 to 104, which can be magnetically coupled.

In FIG. 6, the abutment member 71 is indicated by the dashed line. The abutment member 71 has a circular shape having an area large enough to at least partially include the gaps 101 to 104, and the abutment member 72 (not shown) has a similar shape. For the same reason as described above, it is preferable that the circle including the radially outer ends of the gaps 101 to 103 on the circumference be the maximum area of the end surfaces of the abutment members 71, 72. When the core body 5 is interposed in the axial direction between the abutment members 71, 72, the opposite ends of the iron cores 41 to 44 are fastened to each other.

Figure 7:
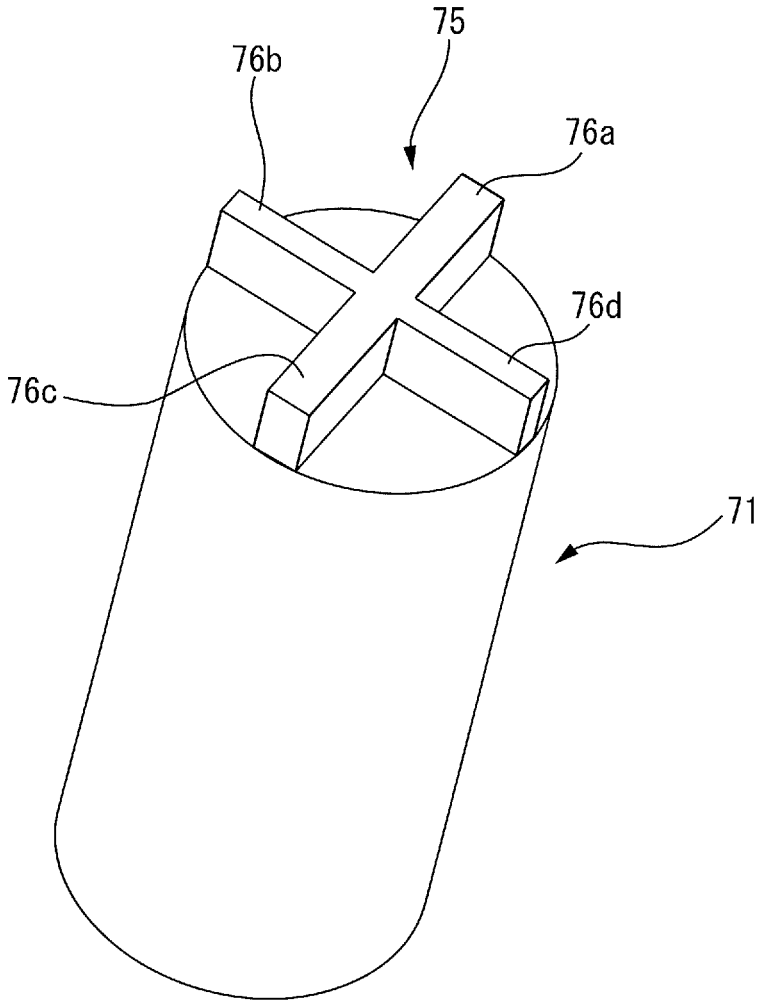
FIG. 7 is a perspective view of an abutment member used in the reactor according to the second embodiment.

FIG. 7 is a perspective view of an abutment member used in the reactor according to the second embodiment. The abutment member 71 is provided on one surface thereof with a substantially X-shaped projection 75. The projection 75 shown in FIG. 7 includes raised portions 76*a* to 76*d*, similar to those described above, which are configured to be engageable with the gaps 101 to 104. When the abutment members 71, 72 having such projections 75 are used, since the projections 75 engage with the gaps 101 to 104, the iron cores 41 to 44 can be more tightly fastened. Thus, the same effects as described above can be obtained.

Aspects of the Disclosure

According to the first aspect, provided is a reactor (6) comprising a core body (5), the core body comprising an outer peripheral iron core (20) composed of a plurality of outer peripheral iron core portions (24 to 27), at least three iron cores (41 to 44) coupled to the plurality of outer peripheral iron core portions, and coils (51 to 54) wound onto the at least three iron cores; wherein gaps (101 to 104), which can be magnetically coupled, are formed between one of the at least three iron cores and another iron core adjacent thereto; the reactor further comprising a terminal (65) and a base (60) which are fastened to the core body so as to interpose the core body therebetween, a first abutment member (71) attached to the base and is configured to abut one end of the at least three iron cores between the base and the core body, and a second abutment member (72) attached to the terminal and is configured to abut the other end of the at least three iron cores between the core body and the terminal.

According to the second aspect, in the first aspect, a projection (75) which at least partially engages with the gaps is formed on an end face of at least one of the first abutment member and the second abutment member.

According to the third aspect, in the first or second aspect, the first abutment member and the second abutment member are configured to be detachable from the terminal and the base.

According to the fourth aspect, in any of the first through third aspects, the first abutment member and the second abutment member are formed from a non-magnetic material.

According to the fifth aspect, in any of the first through fourth aspects, the number of the at least three iron cores is a multiple of three.

According to the sixth aspect, in any of the first through fourth aspects, the number of the at least three iron cores is an even number not less than 4.

Effects of the Aspects

In the first aspect, since the abutment members abut the centers of the opposite end surfaces of the core body, the plurality of iron coils can be tightly fastened. Further, since it is not necessary to form a through-hole in the center of the core body to fasten the plurality of iron cores, it is not necessary to increase the widths of the iron cores to ensure the gap length. Thus, it is possible to tightly fasten the plurality of iron cores without an increase in the sizes of the iron cores and the outer peripheral iron core.

In the second aspect, since the projection engages with the gaps, the iron cores can be further tightly fastened. Further, it is possible to prevent foreign matter from entering the gaps, and it is possible to maintain the dimensions of the gaps.

In the third aspect, the abutment members can be attached to existing reactors.

In the fourth aspect, the non-magnetic material is preferably, for example, aluminum, SUS, a resin, or the like, and as a result, it is possible to prevent the magnetic field from passing through the abutment members.

In the fifth aspect, the reactor can be used as a three-phase reactor.

In the sixth aspect, the reactor can be used as a single-phase reactor.

Though the present invention has been described using representative embodiments, a person skilled in the art would understand that the foregoing modifications and various other modifications, omissions, and additions can be made without departing from the scope of the present invention.

The invention claimed is:

1. A reactor, comprising:

a core body, wherein the core body comprises an outer peripheral iron core composed of a plurality of outer peripheral iron core portions, at least three iron cores which are arranged inside the outer peripheral iron core and which are coupled to the plurality of outer peripheral iron core portions, and coils wound around the at least three iron cores, gaps are formed at the center of the core body between one of the at least three iron cores and another iron core adjacent thereto, through which gaps the iron cores are magnetically connectable, the reactor further comprises:

a terminal and a pedestal which are fastened to the core body so as to interpose the core body therebetween, a first abutment member which is attached to the pedestal and which abuts one end of the at least three iron cores between the pedestal and the core body, and a second abutment member which is attached to the terminal and which abuts the other ends of the at least three iron cores between the core body and the terminal, wherein the first abutment member abuts the center of an end surface of the core body, wherein the second abutment member abuts the center of the other end surface of the core body, and wherein the end surfaces of the first abutment member and the second abutment member have shapes and areas which at least partially include the gaps.

2. The reactor according to claim 1, wherein a projection which at least partially engages with the gaps is formed in the end surface of at least one of the first abutment member and the second abutment member.

3. The reactor according to claim 1, wherein the first abutment member and the second abutment member are configured so as to be detachable from the terminal and the pedestal.

4. The reactor according to claim 1, wherein the first abutment member and the second abutment member are formed from a non-magnetic material.

5. The reactor according to claim 1, wherein the number of the at least three iron cores is a multiple of three.

6. The reactor according to claim 1, wherein the number of the at least three iron cores is an even number not less than four.

7. The reactor according to claim 1, wherein the first abutment member is formed integrally with an upper surface of the pedestal and the second abutment member is formed integrally with a lower surface of the terminal.

* * * * *